US009402420B2

(12) United States Patent
Barrett

(10) Patent No.: US 9,402,420 B2
(45) Date of Patent: Aug. 2, 2016

(54) SMOKING ACCESSORY KIT SYSTEM

(71) Applicant: Colby Barrett, Carmichael, CA (US)

(72) Inventor: Colby Barrett, Carmichael, CA (US)

( * ) Notice: Subject to any disclaimer, the term of this patent is extended or adjusted under 35 U.S.C. 154(b) by 147 days.

(21) Appl. No.: 14/181,655

(22) Filed: Feb. 15, 2014

(65) Prior Publication Data

US 2015/0230520 A1 Aug. 20, 2015

(51) Int. Cl.

| | |
|---|---|
| ***A24F 17/00*** | (2006.01) |
| ***A24C 5/08*** | (2006.01) |
| ***A24C 5/44*** | (2006.01) |

(52) U.S. Cl.

CPC . *A24F 17/00* (2013.01); *A24C 5/08* (2013.01); *A24C 5/44* (2013.01)

(58) Field of Classification Search

CPC ..... A24F 17/00; B65D 25/005; B65D 1/34
USPC ..... 206/236–238, 818, 702
See application file for complete search history.

(56) References Cited

U.S. PATENT DOCUMENTS

| | | | | | |
|---|---|---|---|---|---|
| 3,697,737 | A | | 10/1972 | Levkoff | |
| 3,705,982 | A | | 12/1972 | Smolinski | |
| 3,946,747 | A | | 3/1976 | Staroba et al. | |
| 4,153,927 | A | | 5/1979 | Owens | |
| 4,955,162 | A | * | 9/1990 | Jackson | B24B 23/00 451/279 |
| 4,989,734 | A | * | 2/1991 | Mode | A47F 13/00 206/225 |
| 5,135,012 | A | * | 8/1992 | Kamen | A45C 13/02 132/294 |
| 5,430,628 | A | | 7/1995 | Saunders | |
| 5,533,621 | A | * | 7/1996 | Schoal, Jr. | A47K 10/3827 206/409 |
| 5,957,277 | A | * | 9/1999 | Elliott | A24F 25/02 206/205 |
| 6,315,120 | B1 | * | 11/2001 | Tally | B25H 3/00 206/350 |
| D498,554 | S | | 11/2004 | Agresto, Sr. | |
| 7,282,249 | B2 | | 10/2007 | Harrison et al. | |
| D570,166 | S | | 6/2008 | Brownlee | |
| 2004/0200080 | A1 | * | 10/2004 | Lauri | A45F 5/02 30/541 |
| 2006/0237026 | A1 | | 10/2006 | Simester | |
| 2006/0243632 | A1 | * | 11/2006 | Trahan | B65D 1/34 206/557 |
| 2010/0059538 | A1 | | 3/2010 | Van De Perre | |
| 2010/0224527 | A1 | * | 9/2010 | Huang | B25H 3/028 206/503 |
| 2013/0155657 | A1 | * | 6/2013 | Werner | B25H 3/023 362/154 |
| 2013/0199549 | A1 | * | 8/2013 | Spurling | F23Q 2/32 131/253 |
| 2014/0374306 | A1 | * | 12/2014 | Domon | A24F 15/08 206/581 |

* cited by examiner

*Primary Examiner* — Anthony Stashick
*Assistant Examiner* — Robert Poon

(57) ABSTRACT

A smoking accessory kit system facilitates the process of hand-rolling cigarettes, cigars or the like. The system includes a primary tray having a bottom wall and a perimeter wall coupled to and extending upwardly from the bottom wall. A top edge of the perimeter wall defines an access opening into an interior of the primary tray. A plurality of magnets is attached to the primary tray. A plurality of attachments is magnetically attachable to the primary tray.

10 Claims, 7 Drawing Sheets

26
32
28
36
36
32
38
38
38

SMOKING ACCESSORY KIT SYSTEM

BACKGROUND OF THE DISCLOSURE

Field of the Disclosure

The disclosure relates to smoking accessory kits and more particularly pertains to a new smoking accessory kit for facilitating the process of hand-rolling cigarettes, cigars or the like.

SUMMARY OF THE DISCLOSURE

An embodiment of the disclosure meets the needs presented above by generally comprising a primary tray having a bottom wall and a perimeter wall coupled to and extending upwardly from the bottom wall. A top edge of the perimeter wall defines an access opening into an interior of the primary tray. A plurality of magnets is attached to the primary tray. A plurality of attachments is magnetically attachable to the primary tray.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
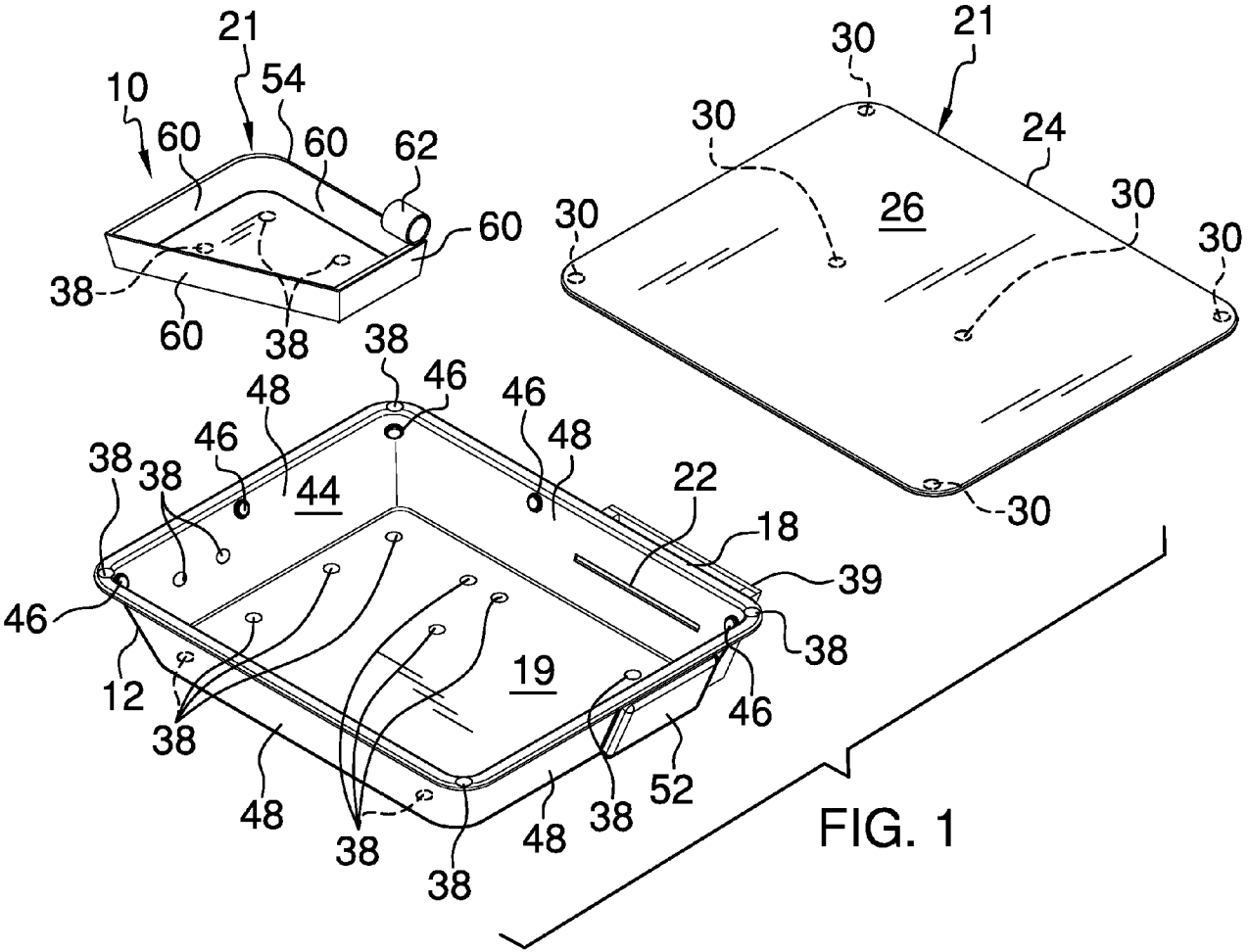
FIG. 1 is a top rear side perspective view of a smoking accessory kit system according to an embodiment of the disclosure.
Figure 2:
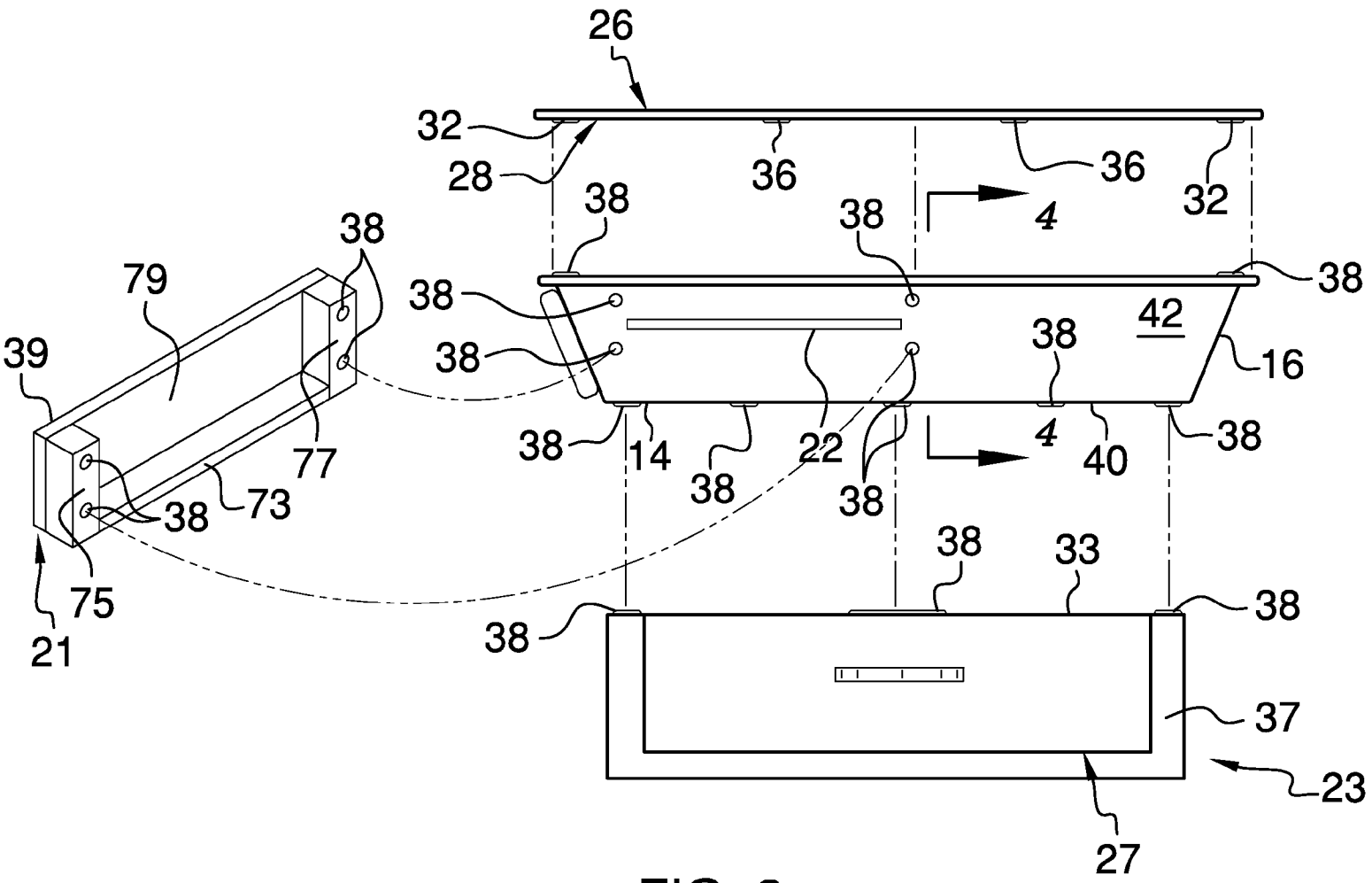
FIG. 2 is a front view of the cover and the drawer unit and a top front side perspective view of the dispenser unit of an embodiment of the disclosure.
Figure 3:
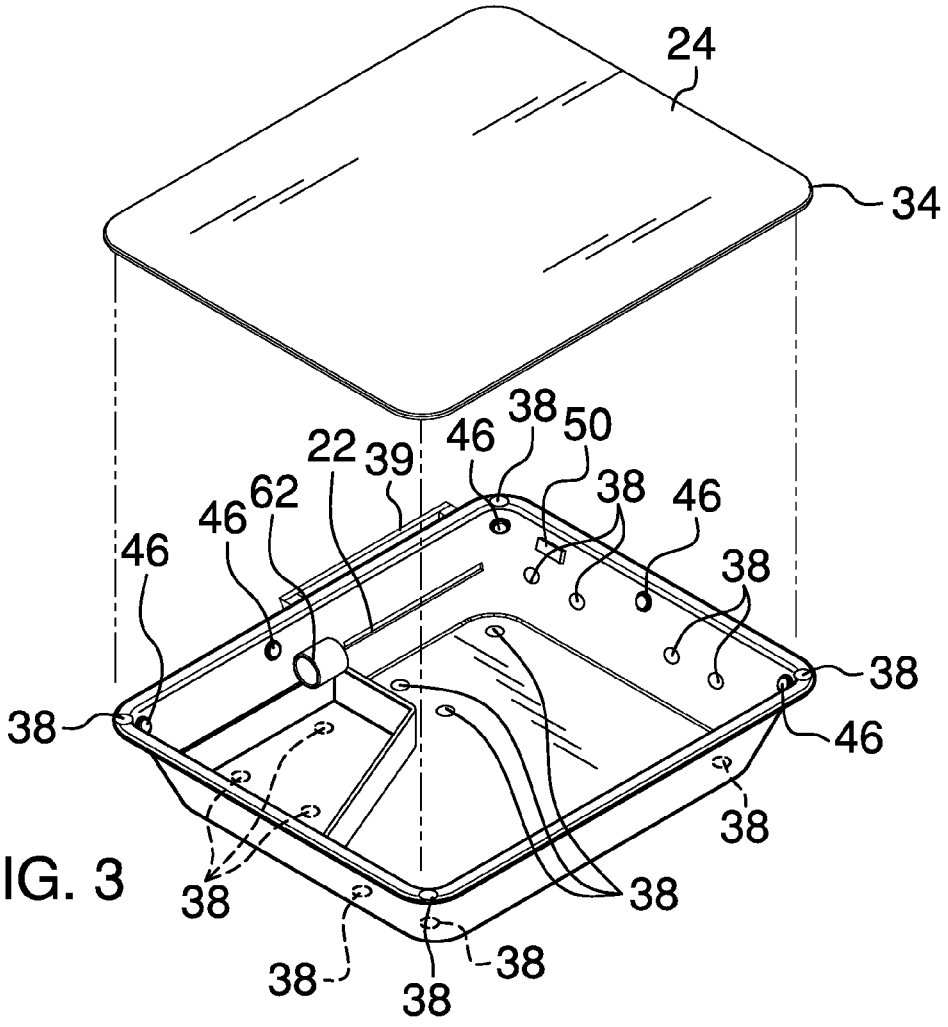
FIG. 3 is a top rear side perspective view of an embodiment of the disclosure.
Figure 4:
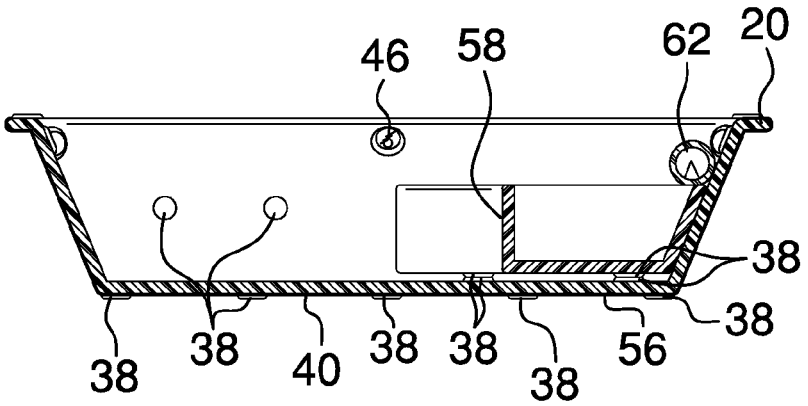
FIG. 4 is a cross-sectional view of an embodiment of the disclosure taken along line 4-4 of FIG. 2.
Figure 5:
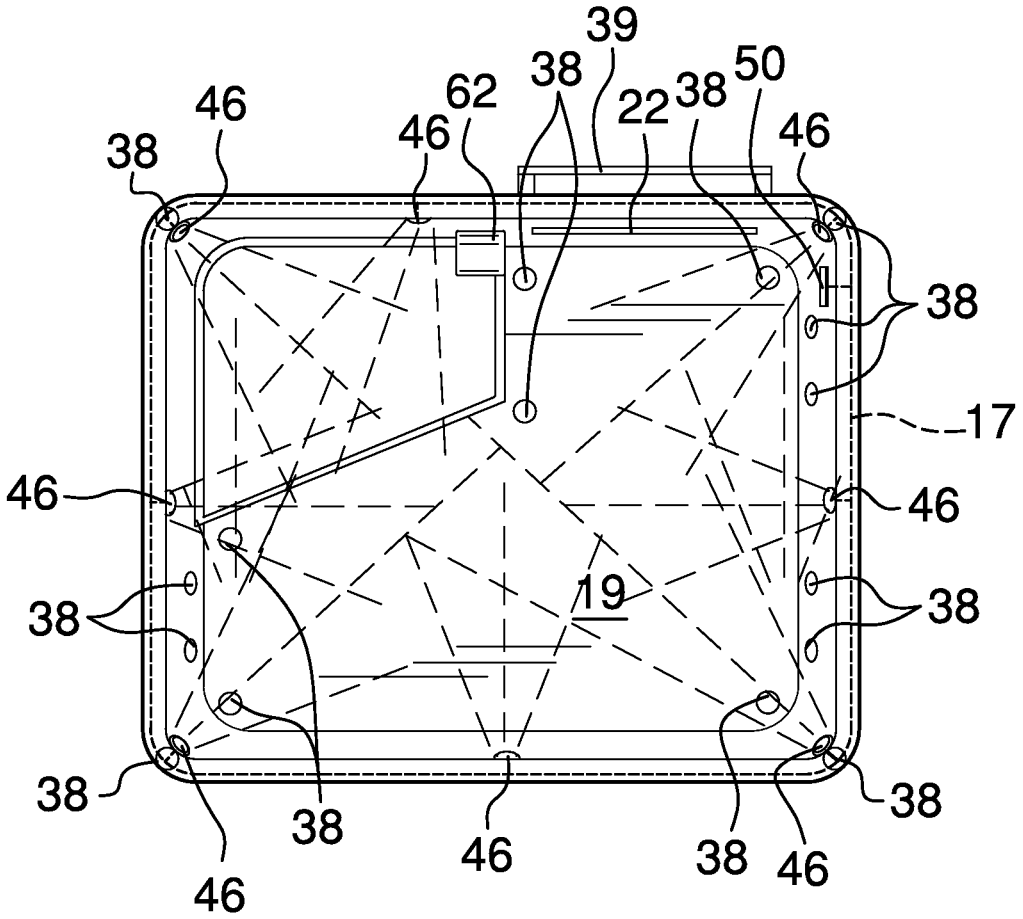
FIG. 5 is a top view of an embodiment of the disclosure.
Figure 6:
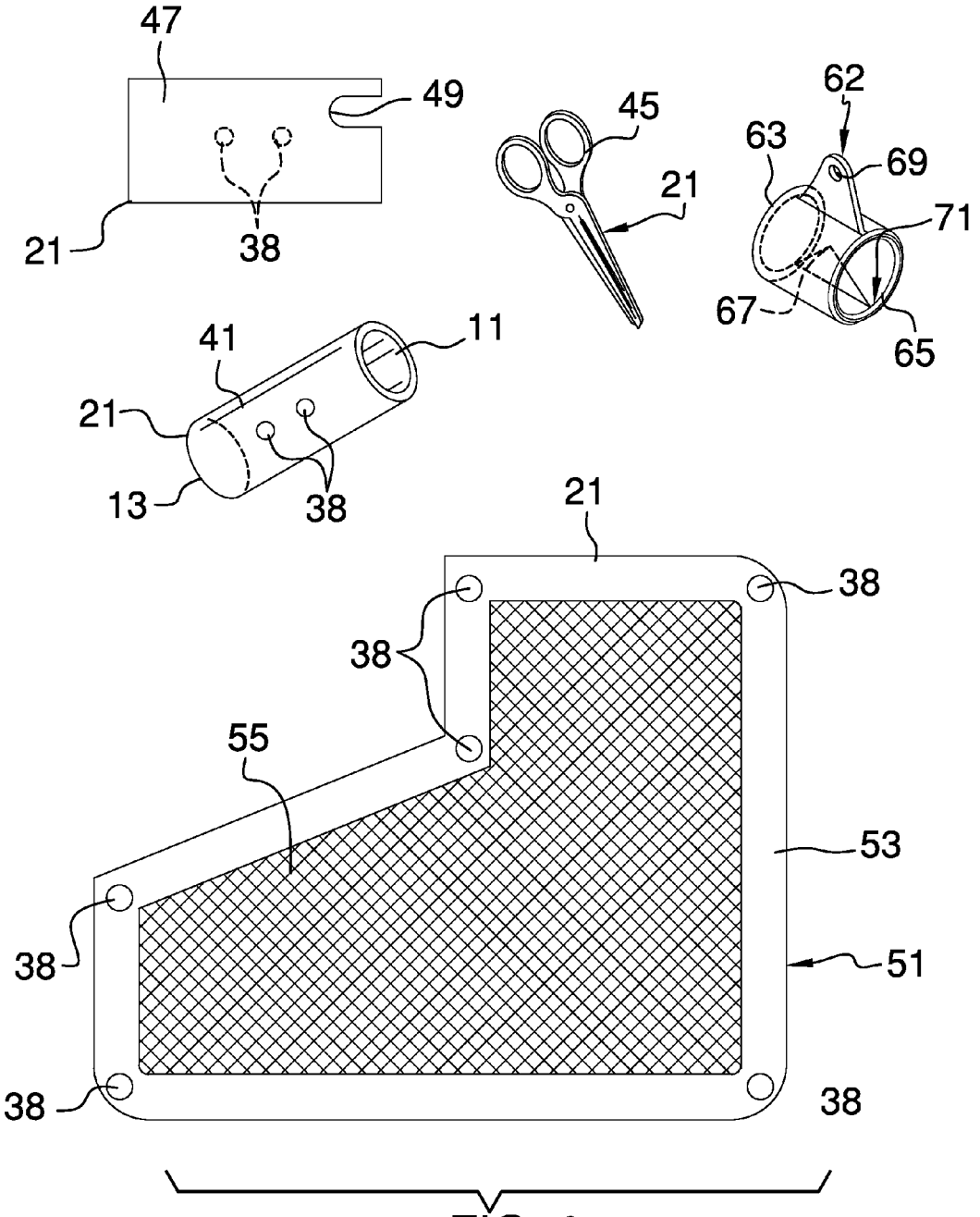
FIG. 6 is a detailed view of the scissors, the planar panel, the holder, the splitter and the sifting unit showing each unattached to the primary tray.
Figure 7:
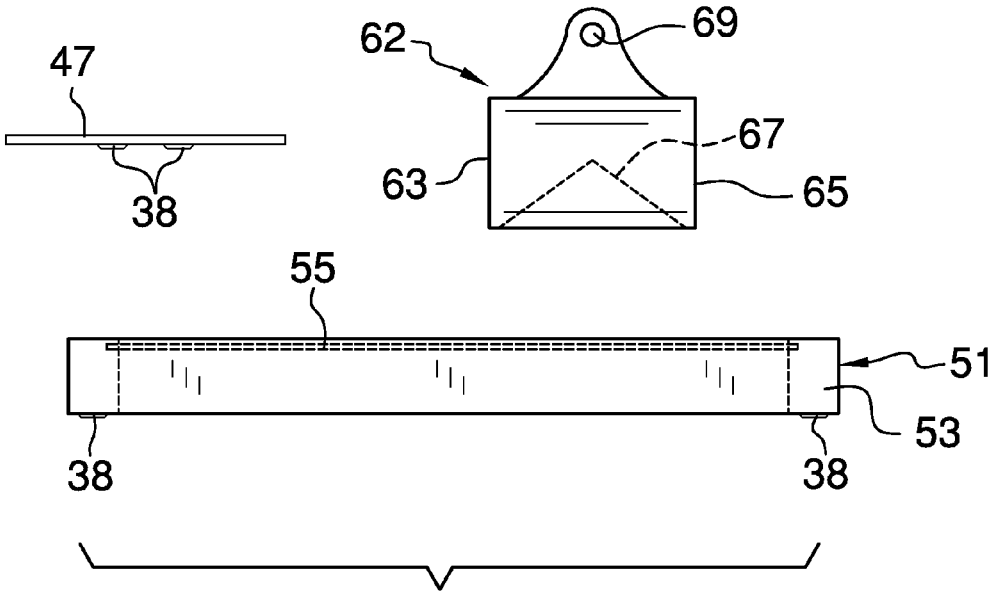
FIG. 7 is a front view of the splitter, the sifting unit and the planar panel of an embodiment of the disclosure.
Figure 8:
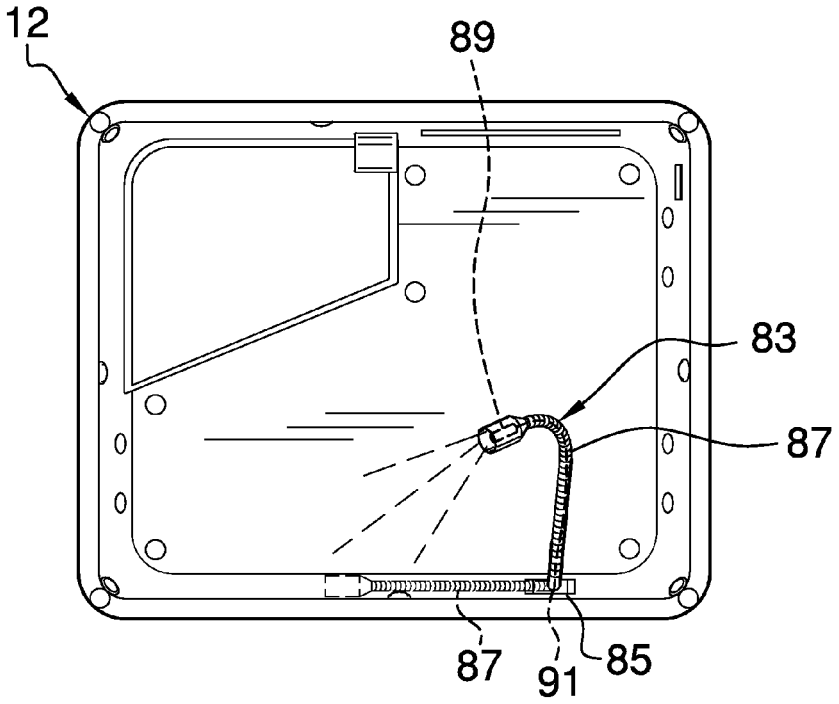
FIG. 8 is a top view of an alternative embodiment of the dislosure showing the supplemental light assembly and its flexible neck.
Figure 9:
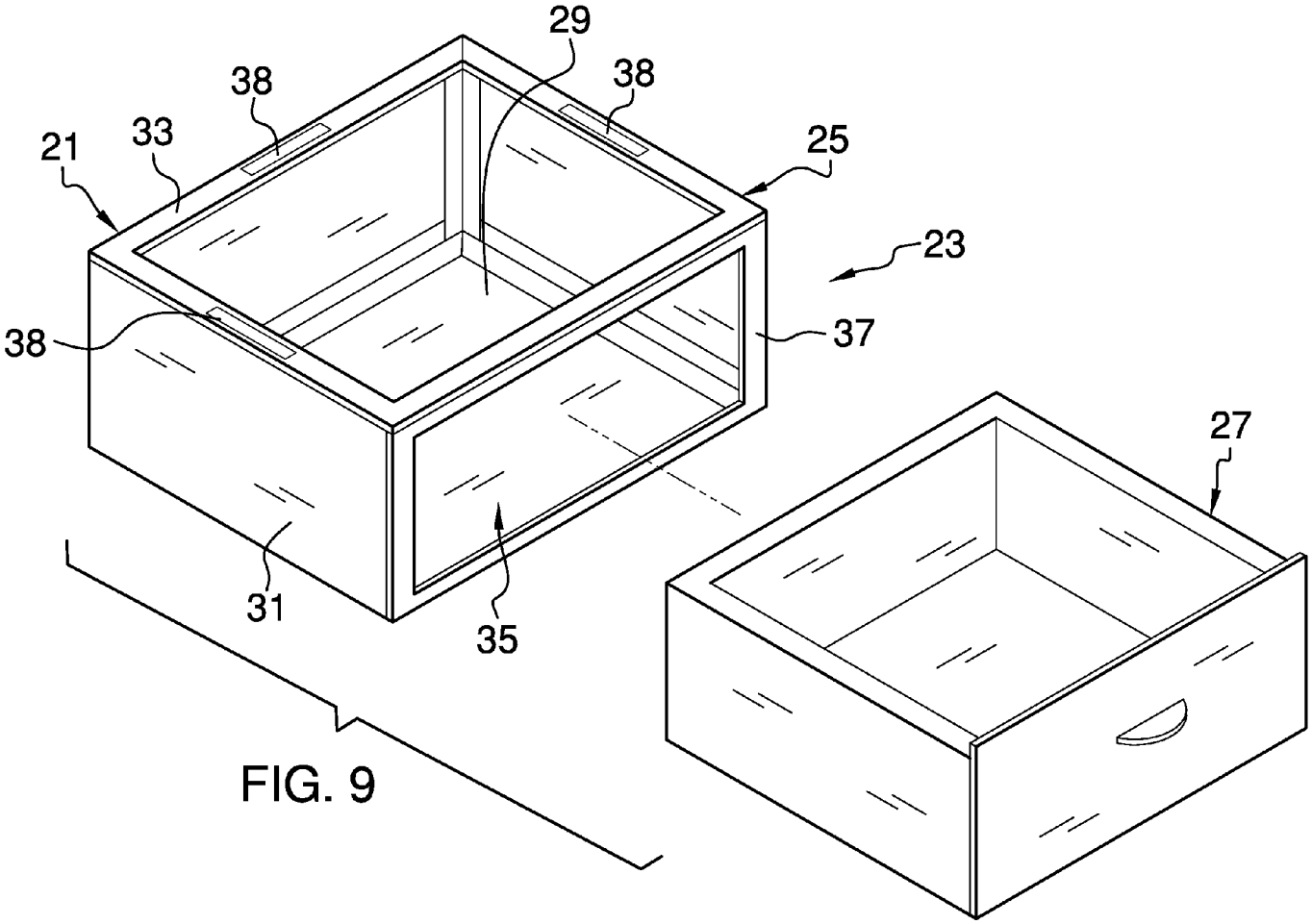
FIG. 9 is a top front side perspective view of a drawer unit of an embodiment of the disclosure.

With reference now to the drawings, and in particular to FIGS. 1 through 9 thereof, a new smoking accessory embodying the principles and concepts of an embodiment of the disclosure and generally designated by the reference numeral 10 will be described.

As best illustrated in FIGS. 1 through 9, the smoking accessory kit system 10 generally comprises a primary tray 12 having a bottom wall 14 and a perimeter wall 16 coupled to and extending upwardly from the bottom wall 14. A top edge 18 of the perimeter wall 16 defines an access opening into an interior of the primary tray 12. The perimeter wall 16 may taper inwardly from the top edge 18 of the perimeter wall 16 to the bottom wall 14. The access opening is bounded by a lip 20 extending outwardly beyond the perimeter wall 16. The tray 12 may be constructed from plastic or like material. The bottom wall 14 may have a length along its longitudinal axis between approximately 18.0 cm and 30.0 cm. An elongated slot 22 is positioned in the perimeter wall 16. The slot 22 is configured to receive rolling paper therethrough. The slot 22 may have a length between approximately 7.0 cm and 12.0 cm and a height between approximately 0.5 cm and 1.0 cm.

A plurality of attachments 21 is provided and each is magneticall attractable to the primary tray 12. The plurality of attachments 21 includes a cover 24 positionable over the top edge 18 of the perimeter wall 16 to cover the access opening. The cover 24 is magnetically attachable to the top edge 18 of the perimeter wall 16. The cover 24 has a planar upper surface 26 and a planar bottom surface 28. A plurality of magnets 38 is provided. At least some of the magnets 38 are coupled to the cover 24. The magnets 30 include a plurality of outer magnets 32 coupled to the cover 24 proximate an outer edge 34 of the cover 24 and a plurality of inner magnets 36 coupled to the cover 24 and spaced from the outer edge 34 of the cover 24. The cover 24 may have a length along its longitudinal axis between approximately 20.0 cm and 35.0 cm. At least some of the magnets 38 are coupled to each of the primary tray 12, the top edge 18 of the perimeter wall 16, a lower surface 40 of the bottom wall 14, and a top surface 19 of the bottom wall 14. Associated ones of the magnets 38 on the lower surface 40 of the bottom wall 14 are magnetically attractable to the inner magnets 36 wherein the cover 24 is releasably couplable to the bottom wall 14. At least some of the magnets 38 are coupled to an exterior surface 42 of the perimeter wall 16 and extend around the slot 22. Similarly, at least some of the magnets 38 are coupled to an inner surface 44 of the perimeter wall 16. This allows at least some of the attachments 21 to be magnetically attached to the perimeter wall 16 of the primary tray 12.

The plurality of attachments 21 further includes a dispenser unit 39 having a front panel 73, a pair of side panels 75, 77 and a back panel 79. The side panels 75, 77 are coupled to and extend between the front panel 73 and the back panel 79. The front panel 73 abuts the back panel 79 and is positioned parallel with respect to the back panel 79. The dispenser unit 39 is configured to support the rolling paper adjacent to the elongated slot 22. The dispenser unit 39 may have a length between approximately 8.0 cm and 13.0 cm and a height between approximately 3.5 cm and 4.0 cm.

Additional ones of the attachments 21 may include a holder 41 having an open top 11 and a closed bottom 13 wherein the holder 41 is configured to receive a conventional lighter therein. Magnets 38 may be attached to the holder 41 for magnetically coupling the holder 41 to the primary tray 12. Alternatively, the holder 41 may be constructed out of stainless steel to permit magnetic coupling with the primary tray 12. Another attachment 21 may include a scissors 45 made of stainless steel or one having magnets 38 attached thereto for magnetically coupling the scissors 45 to the primary tray 12. Another attachment 21 may include a planar panel 47 having an arcuate slit 49 extending therein. The slit 49 allows a person to poke an end of a cigarette or the like to ensure that the material is packed tightly within the rolling paper. The panel 47 includes magnets 38 to allow the panel 47 to be magnetically attached to the primary tray 12.

One of the attachments 21 may include a sifting unit 51 having an outer wall 53 and a mesh screen 55. The outer wall 53 is attached to and extends around the mesh screen 55. The sifting unit 51 permits a person to sift, and therefore extract, pollen or like material from a tobacco product. Magnets 38 may be attached to the outer wall 53 to permit the sifting unit 51 to magetically attach to the primary tray 12. The sifting unit 51 has a size and shape such that the sifting unit 51 is able to fit within the primary tray 12. The mesh screen 55 is spaced above the bottom wall 14 when the sifting unit 51 is positioned in the primary tray 12. The outer wall 53 may be constructed from wood, plastic or like material.

The plurality of attachments 21 further includes a secondary tray 54 being magnetically attachable to the interior of the primary tray 12. The secondary tray 54 has a lower wall 56 and a peripheral wall 58 coupled to and extending upwardly from the lower wall 56. The associated magnets 38 are attached to the lower wall 56 of the secondary tray 54. The secondary tray 54 defines an ashtray configured to receive ashes and butts of cigarettes, cigars or the like. The secondary tray 54 is constructed from a fireproof material, such as glass or the the like. The peripheral wall 58 of the secondary tray 54 includes a plurality of sides 60. One of the sides 60 of the peripheral wall 58 may be angled.

The plurality of attachments 21 also includes a drawer unit 23 having a drawer frame 25 and a drawer 27. The drawer frame 25 has a lower wall 29 and a peripheral wall 31 coupled to and extending upwardly from the lower wall 29. The drawer frame 25 has an upper edge 33 defining an access opening into the drawer frame 25. An opening 35 is positioned in a front end 37 of the peripheral wall 31. The drawer 27 is insertable into and slidably extendable from the opening 35. A plurality of magnets 38 is also attached to the upper edge 33 of the drawer frame 25 for magnetically attaching the drawer frame 25 to the lower surface 40 of the bottom wall 14.

A splitter 62 is provided having opposite ends 63, 65 being open. The splitter 62 includes a blade 67 positioned between the opposite ends 63, 65 for allowing a cigar, cigarrette or the like to be split open for removing tobacco therefrom. The blade 67 may be triangular and is attached to an inner surface 71 of the splitter 62. The splitter 62 may include an aperture 69 such that the splitter 62 can be coupled to the secondary tray 54 by inserting screws or other conventional fasteners through the aperture and engaging the secondary tray 54. The splitter 62 may be made from plastic or like material.

At least one light 46, and preferably a plurality of lights 46, is coupled to the primary tray 12. The lights 46 on the primary tray 12 may be coupled to the inner surface 44 of each side 48 of the perimeter wall 16. A plurality of the lights 46 may be directed toward the secondary tray 54 when the secondary tray 54 is attached to the primary tray 12 to illuminate the secondary tray 54 as desired. The lights 46 for the secondary tray 54 may emit colored light, while the remaining lights 46 may emit white light. A light actuator 50 is coupled to the primary tray 12. The light actuator 50 is electrically coupled to each light 46 wherein manipulation of the light actuator 50 actuates each light 46. A power source 52 is coupled to the primary tray 12. The power source 52 is electrically coupled to the light actuator 50 and each light 46 for providing power to each light 46. The power source 52 may comprise at least one rechargeable battery. Wiring 17 is electrically coupled to and extends between the light actuator 50 and each of the lights 46. The wiring 51 may be housed within the lip 20. A supplemental light assembly 83 may be attached to the primary tray 12 and may include a base 85, a flexible neck 87, and a light 89. The flexible neck 87 is coupled to and extends between the base 85 and the light 89 and allows the light 89 to be positioned at a selectable angle relative to the primary tray 12. The light 89 may comprise a light emitting diode. A battery 91 may be positioned within the base 85 to provide electrical power to the light 89.

In use, as stated above and shown in the Figures, the material to be rolled is placed into the primary tray 12. The light actuator 50 is used to actuate the lights 46. The rolling paper can be dispensed through the slot 22 and rolled in a conventional manner to hand-roll cigars, cigarettes or the like. The secondary tray 54 is attached to the primary tray 12 to provide an ashtray. The cover 24 can be magnetically attached to the lower surface 40 of the bottom wall 14 while the primary 12 or secondary 54 trays are being used. Between uses, the cover 24 can be attached to the primary tray 12 such that the cover 24 closes the access opening. Any additional attachments 21, such as those described above, can be magnetically attached to the primary tray 12 for convenient access to those attachments 21.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A smoking accessory kit system comprising:

a primary tray having a bottom wall and a perimeter wall coupled to and extending upwardly from said bottom wall, a top edge of said perimeter wall defining an access opening into an interior of said primary tray;

a plurality of magnets being attached to said primary tray;

a plurality of attachments being magnetically attachable to said primary tray, wherein said plurality of attachments includes a secondary tray being magnetically attachable to said interior of said primary tray, said secondary tray having a lower wall and a peripheral wall coupled to and extending upwardly from said lower wall, said secondary tray defining an ashtray;

at least one light being coupled to said primary tray;

an elongated slot positioned in said perimeter wall, said slot being configured to receive rolling paper therethrough;

at least two of said magnets being coupled to an exterior surface of said perimeter wall and extending around said slot;

said plurality of attachments including a dispenser unit having a front panel, a pair of side panels and a back panel, said side panels being coupled to and extending between said front and back panels, said front panel abutting said back panel and being positioned parallel with respect to said back panel said dispenser unit being configured to support the rolling paper adjacent to said elongated slot, one of said attachments including a planar panel having an arcuate slit extending therein;

at least two of said magnets being attached to said dispenser unit for magnetically attaching said dispenser unit to said perimeter wall of said primary tray;

a splitter coupled to said secondary tray, said splitter having opposite ends each being open, a blade being positioned within said splitter;

at least some of said magnets being coupled to a lower surface of said bottom wall;

said plurality of attachments including a drawer unit, said drawer unit including a drawer frame and a drawer, said drawer frame having a lower wall and a peripheral wall coupled to and extending upwardly from said lower wall, said drawer frame having an upper edge defining an access opening into said drawer frame, an opening being positioned in a front end of said peripheral wall, said drawer being insertable into and slidably extendable from said opening;

at least some of said magnets being attached to said upper edge of said drawer frame for magnetically attaching said drawer frame to said lower surface of said bottom wall;

one of said attachments including a sifting unit having an outer wall and a mesh screen, said outer wall being attached to and extending around said mesh screen;

at least some of said magnets being attached to said outer wall to permit said sifting unit to magnetically attach to said primary tray; and a supplemental light assembly attached to said primary tray, said supplemental light assembly including a base, a flexible neck, and a light, said flexible neck being coupled to and extending between said base and said light for allowing said light to be positioned at a selectable angle relative to said primary tray.

2. The system of claim 1, further comprising said perimeter wall tapering inwardly from said top edge of said perimeter wall to said bottom wall.

3. The system of claim 1, further comprising said access opening being bounded by a lip extending outwardly beyond said perimeter wall.

4. The system of claim 1, further comprising said light being one of a plurality of said lights, said lights on said primary tray being coupled to an inner surface of each side of said perimeter wall.

5. The system of claim 1, further comprising a power source being coupled to said primary tray, said power source being electrically coupled to each said light for providing power to each said light.

6. The system of claim 1, further comprising said plurality of attachments including a cover positionable over said top edge of said perimeter wall to cover said access opening, said cover being magnetically attachable to said top edge of said perimeter wall.

7. The system of claim 1, further comprising said magnets including a plurality of inner magnets coupled to said cover and being spaced from an outer edge of said cover.

8. The system of claim 7, further comprising at least some of said magnets being coupled to a lower surface of said bottom wall, at least some of said magnets on said lower surface of said bottom wall being magnetically attractable to said inner magnets wherein said cover is releasably couplable to said bottom wall.

9. The system of claim 1, further comprising a light actuator coupled to said primary tray, said light actuator being electrically coupled to each said light wherein manipulation of said light actuator actuates each said light.

10. A smoking accessory kit system comprising:

a primary tray having a bottom wall and a perimeter wall coupled to and extending upwardly from said bottom wall, a top edge of said perimeter wall defining an access opening into an interior of said primary tray, said perimeter wall tapering inwardly from said top edge of said perimeter wall to said bottom wall, said access opening being bounded by a lip extending outwardly beyond said perimeter wall;

an elongated slot positioned in said perimeter wall, said slot being configured to receive rolling paper therethrough;

a plurality of attachments being magnetically attachable to said primary tray, said attachments including;

a cover positionable over said top edge of said perimeter wall to cover said access opening, said cover being magnetically attachable to said top edge of said perimeter wall, said cover having a planar upper surface and a planar bottom surface;

a secondary tray being magnetically attachable to said interior of said primary tray, said secondary tray having a lower wall and a peripheral wall coupled to and extending upwardly from said lower wall, said secondary tray defining an ashtray, said peripheral wall of said secondary tray including a plurality of sides, one of said sides of said peripheral wall being angled;

a dispenser unit having a front panel, a pair of side panels and a back panel, said side panels being coupled to and extending between said front and back panels, said front panel abutting said back panel and being positioned parallel with respect to said back panel said dispenser unit being configured to support the rolling paper adjacent to said elongated slot;

a drawer unit, said drawer unit including a drawer frame and a drawer, said drawer frame having a lower wall and a peripheral wall coupled to and extending upwardly from said lower wall, said drawer frame having an upper edge defining an access opening into said drawer frame, an opening being positioned in a front end of said peripheral wall, said drawer being insertable into and slidably extendable from said opening, said drawer unit being attached to said bottom wall of said primary tray;

a sifting unit having an outer wall and a mesh screen, said outer wall being attached to and extending around said mesh screen; and a planar panel having an arcuate slit extending therein;

a plurality of magnets, said magnets including a plurality of magnets coupled to said cover, said magnets including a plurality of outer magnets coupled to said cover proximate an outer edge of said cover and a plurality of inner magnets coupled to said cover and spaced from said outer edge of said cover, said magnets including a plurality of magnets coupled to said primary tray, at least some of said magnets being coupled to said top edge of said perimeter wall, at least some of said magnets being coupled to a lower surface of said bottom wall, said magnets on said lower surface of said bottom wall being magnetically attractable to said inner magnets wherein said cover is releasably couplable to said bottom wall, at least some of said magnets being coupled to an exterior surface of said perimeter wall and extending around said slot, at least some of said magnets being coupled to an inner surface of said perimeter wall, said magnets including a plurality of magnets being coupled to an inner surface of said perimeter wall for magnetically coupling associated ones of said attachments thereto, at least some of said magnets being attached to said upper edge of said drawer frame for magnetically attaching said drawer frame to said lower surface of said bottom wall;

at least one light being coupled to said primary tray, said light being one of a plurality of said lights, said lights on said primary tray being coupled to said inner surface of each side of said perimeter wall;

a light actuator coupled to said primary tray, said light actuator being electrically coupled to each said light wherein manipulation of said light actuator actuates each said light;

a power source being coupled to said primary tray, said power source being electrically coupled to said light actuator and each said light for providing power to each said light;

a supplemental light assembly attached to said primary tray, said supplemental light assembly including a base, a flexible neck, and a light, said flexible neck being coupled to and extending between said base and said light for allowing said light to be positioned at a selectable angle relative to said primary tray; and a splitter coupled to said secondary tray, said splitter having opposite ends each being open, a blade being positioned within said splitter.

* * * * *